United States Patent [19]

Bisping et al.

[11] Patent Number: 4,542,696

[45] **Date of Patent: * Sep. 24, 1985**

[54] MUNITIONS ROUND FOR BARREL-TYPE WEAPONS

[75] Inventors: Bernhard Bisping, Ratingen; Peter Wallow, Dusseldorf; Klaus Gersbach, Willich; Rudolf Romer, Kaarst, all of Fed. Rep. of Germany

[73] Assignee: Rheinmetall GmbH, Dusseldorf, Fed. Rep. of Germany

[ * ] Notice: The portion of the term of this patent subsequent to Apr. 24, 2001 has been disclaimed.

[21] Appl. No.: 547,736

[22] Filed: Nov. 1, 1983

Related U.S. Application Data

[63] Continuation-in-part of Ser. No. 68,865, Aug. 21, 1979, Pat. No. 4,444,114.

[30] Foreign Application Priority Data

Aug. 24, 1978 [DE] Fed. Rep. of Germany ..... 2836963

[51] Int. Cl.[4] ..... F42B 5/02

[52] U.S. Cl. ..... 102/430; 102/523; 102/703

[58] Field of Search ..... 102/430, 520–523

[56] References Cited

U.S. PATENT DOCUMENTS

| | | | |
|---|---|---|---|
| 45,023 | 11/1864 | Cleu | 102/520 |
| 1,746,553 | 2/1930 | Olmstead | 102/430 |
| 2,998,780 | 9/1961 | Anspacher et al. | 102/523 |
| 3,148,472 | 9/1964 | Hegge et al. | 102/521 |
| 3,496,869 | 2/1970 | Engel | 102/522 |
| 3,834,314 | 9/1974 | Young | 102/703 |
| 3,981,246 | 9/1976 | Luther | 102/521 |
| 4,015,527 | 4/1977 | Evans | 102/703 |
| 4,063,486 | 12/1977 | Ashley | 102/703 |
| 4,187,783 | 2/1980 | Campoli et al. | 102/521 |
| 4,215,632 | 8/1980 | Sie | 102/521 |
| 4,444,114 | 4/1984 | Bisping | 102/430 |

*Primary Examiner*—Harold J. Tudor

*Attorney, Agent, or Firm*—Karl F. Ross; Herbert Dubno

[57] ABSTRACT

A munitions round for a subcaliber projectile to be fired from a barrel-type weapon has a casing, of a uniform outer cross section substantially over its entire length, receiving the projectile which is at least partially surrounded by the gas-generating propellant charge. A drive body is mounted at the forward end of the projectile and has a rearward pressure-receiving surface which droops inwardly toward the projectile from an outer edge of the body which is engaged by the casing. The body is formed from a plurality of segments which form-fittingly hug the projectile and have confronting angularly spaced separating surfaces bridged by a sealing member. The forward end of the body, formed by the segments, is concave forwardly and has a leading edge which is disposed outwardly and axially ahead of the rearward inner edge of this surface which forms a pocket engaging the air upon propulsion of the projectile from the barrel to effect separation of the segments and dislodgment of the body.

10 Claims, 9 Drawing Figures

MUNITIONS ROUND FOR BARREL-TYPE WEAPONS

CROSS-REFERENCE TO RELATED APPLICATION

This application is a continuation-in-part of Ser. No. 68,865 filed Aug. 21, 1979, now U.S. Pat. No. 4,444,114.

FIELD OF THE INVENTION

The present invention relates to a munitions round for barrel-type weapons and, more particularly, to a munitions round of the type in which a casing encloses a propellant charge for driving a subcaliber projectile out of the barrel of a barrel-type weapon, the projectile having a drive cage or body which has a rearwardly turned surface upon which the gas pressure is applied.

BACKGROUND OF THE INVENTION

It is known to provide a munitions round for a barrel-type weapon in which a propellant charge surrounds a fin-stabilized subcaliber projectile of a large length-/diameter ratio which has a releasable drive cage or body separating upon the passage of the projectile and the drive body out of the barrel and permitting the projectile to travel along a ballistic or guided path thereafter.

The drive cage or body has a transition region at which it engages the projectile which form-fittingly grips the latter until the assembly of the projectile and the drive cage leave the barrel. The rear of this drive cage forms a gas-pressure-receiving surface which is usually located ahead of the center of gravity of the projectile. This surface can have a circular outer edge of a diameter substantially corresponding to the caliber of the barrel and an inner edge proximal to the outer periphery of the projectile.

A forward-facing surface of the drive cage has a forward edge which is radially spaced from the periphery of the projectile and from an inner edge substantially at the periphery of the projectile.

With projectiles or munitions rounds of the aforedescribed type it is important to increase the muzzle velocity and distance or range of the projectile which requires consideration of inner ballistics factors, barrel structure and the configuration of the projectile.

All other things being equal, the range of the projectile can be increased by minimizing the mass of the drive cage so that it forms a relatively small portion of the total mass of the munitions round and the projectile assembly.

A munitions round for the purposes described has been illustrated in U.S. Pat. No. 3,148,472 which relates to a projectile of high length/diameter ratio with a drive cage or body which is composed of a synthetic-resin material to minimize the contribution of this body to the total mass of the assembly displaced through the barrel.

Because of the significant differences in density between the drive cage and the projectile a significant difference arises in the inertias of the two members of the assembly upon firing.

To prevent axial relative movement of the drive cage and the projectile (slip) within the barrel, the two parts must be form-fittingly interconnected.

This is accomplished in the system of U.S. Pat. No. 3,148,472 by forming the drive cage or body in one piece, e.g. by injecting it or casting it around the projectile.

The material of the drive cage or body thus grips the projectile in a transition region at which high shear forces develop between projections or recesses constituting the form-fitting connection at the surface of the projectile.

To enable the significant shear forces to be withstood by the transition region a large contact area is provided between the different materials forming the connection.

However, since the drive body or cage must break away rapidly from the projectile upon the passage of the assembly from the barrel, difficulties are encountered because of the large contact area and the manner in which the form-fitting connection is made.

The aforementioned patent thus proposes to provide regions over the length of the barrel which exceed the normal caliber to create pulsation stresses in the drive cage to facilitate the rupture and separation thereof.

These expedients have been found to be disadvantageous from the point of view of the final ballistics conditions of the projectile and create other problems as well. For example, when the barrel must be modified to ensure the pulsation stresses mentioned previously, the barrel is subjected to a high degree of wear. Such wear of the barrel causes failure and misfiring or unreliable firing of the projectile. The range cannot be reliably ascertained, for example, and ultimately the final ballistics conditions are detrimentally affected.

It also may be mentioned that the increase in the range and improvement of the final ballistics conditions of the projectile by increasing the size of the charge cannot be effective with the system of U.S. Pat. No. 3,148,472 at least in part because it is necessary to increase the length of the munitions round or increase its diameter. This, of course, requires further modifications of the weapon. An increased charge, moreover, induces additional wear of the inordinately expensive weapon with the disadvantages mentioned previously.

OBJECTS OF THE INVENTION

It is the principal object of the present invention to provide a munitions round which avoids the aforedescribed disadvantages and, at the same time, provides improved range and final ballistics conditions with a munitions round of a given length and diameter.

Another object of this invention is to provide an improved munitions round which can be fired from existing barrel-type weapons without significant modification thereof.

Still another object is to improve upon the munitions round claimed in our above-identified prior application.

SUMMARY OF THE INVENTION

These objects and others which will become apparent hereinafter are attained, in accordance with our present invention, by providing a munitions round of the character described, i.e. in which a propellant charge surrounds a fin-stabilized subcaliber projectile of a large length/diameter ratio having a releasable drive cage or body and in which a transition region of the drive cage form-fittingly engages the projectile until its dislodgement, the drive cage or body having a rear gas-pressure-receiving surface located ahead of the center of gravity of the projectile and a front-facing surface which engages the air ahead of the projectie upon its firing from the barrel.

According to the invention, the drive cage has a number of segments mutually contacting at angularly spaced confronting contact surfaces at which the segments can separate. The confronting contact surfaces are bridged by sealing members which prevent escape of gas pressure forwardly of the gas-pressure surface. The outer edge of the gas-pressure surface is axially proximal to the rear edge of the forward face and the pressure surface has a continuous profile drop or droop from the outer edge to the proximity of the periphery of the projectile, i.e. to a rear inner edge of this surface.

A space over or around this gas-pressure surface within the casing is at least partly surrounded by a portion of the propellant charge.

More particularly, the munitions round of the present invention comprises an elongated casing having a closed rear end and an open forward end, a fin-stabilized elongated subcaliber projectile disposed in the casing with clearance, the projectile having a large length/diameter ratio and a center of gravity between its ends, a gas-generating propellant charge in the casing at least partially surrounding the projectile, and an elongated drive body form-fittingly engaging the projectile and disposed at least in part forwardly of the center of gravity in the direction of propulsion of the projectile.

The casing can have a uniform cross section over substantially its entire length and the projectile can be fully received therein.

According to the invention, moreover, the drive body is formed with a plurality of segments mutually contacting at angularly spaced confronting contact surfaces at which the segments separate on emergence of the projectile from the barrel of the weapon. A forwardly concave air-encountering surface is formed by the segments upon emergence of the body with the projectile from the barrel and is defined between a leading outer edge spaced radially from the periphery of the projectile and a trailing inner edge proximal to the periphery of the projectile and rearwardly of the outer edge.

An outer periphery of this body formed by the aforementioned segments has a diameter substantially equal to the caliber of the barrel and is engaged by the forward end of the casing.

At least one sealing member bridges the mutually confronting contact surfaces and a pressure-receiving surface formed by the segments extends rearwardly from the outer periphery of the body at a circular outer edge thereof to an inner edge proximal to the periphery of the projectile and axially rearward of the outer edge of the periphery of the body. The pressure-receiving surface is of progressively decreasing diameter rearwardly and defines a space with the casing receiving the portion of the charge. Furthermore, the pressure-receiving surface is outwardly concave at least in the region of the outer periphery of the body, this outward concavity imparting the aforementioned droop to the surface.

With the provision of the outer edge of the pressure-receiving surface in axial proximity to the rear edge of the air-encountering surface, additional space is gained for the portion of the charge which surrounds the drive cage or body without significant change in the weapon chamber and/or increasing the total length of the munitions round. The projectile is more precisely centered in a barrel at a location well ahead of the center of gravity of the projectile and at a location at which the axial propellant gas force is predominantly applied. In addition, the shape of the pressure-receiving surface provides radially inward forces to ensure a form-locked engagement of the body with the projectile which prevents axial slip and ensures joint movement of the projectile and the body out of the barrel.

According to other features of our present invention, the drive cage or body in the region of the inner rearward edge of the pressure-receiving surface is provided with radial projections whose free ends substantially abut in circular arcs with an outer diameter corresponding to the caliber of the barrel. The radial projections may be formed as ribs which run axially to the region of the outer forward edge of this pressure-receiving surface.

The air-encountering forward surface of the body can form a static-air pocket and can reach rearwardly axially beyond the inner edge of this air-encountering surface.

The shell or casing extends axially beyond the outer edge of the pressure-receiving surface to the region of the forward outer edge of the air-encountering surface. The casing may be composed at least in part of combustible material.

The portion of the charge surrounding the body is advantageously composed at least in part as a coherent pressed member which can have a cylindrical configuration with an inner diameter corresponding substantially to the caliber of the barrel.

BRIEF DESCRIPTION OF THE DRAWING

The above and other objects, features and advantages of our present invention will become more readily apparent from the following description, reference being made to the accompanying drawing in which.

SPECIFIC DESCRIPTION

Figure 1:
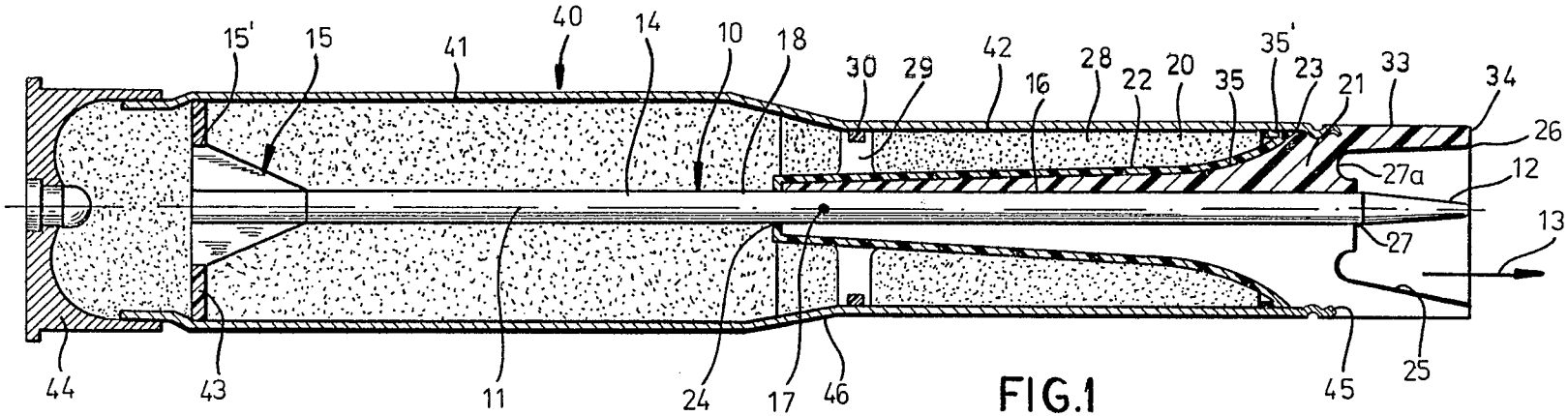
FIG. 1 is an axial cross-sectional view through a first embodiment of a munitions round according to the invention wherein the shell casing extends axially beyond the outer edge of the gas-pressure-receiving surface and in which radial projections are provided in the region of the inner edge of this surface which is formed with a sealing coating for the projectile which has a fin-stabilized subcaliber structure.

In all of the Figures, similarly functioning elements are designated with the same reference numerals.

For simplicity and to enable the differences between the various embodiments to be readily discerned, the munitions rounds will be described in detail only for the first and second embodiments, it being understood that portions not described or not illustrated in other embodiments can be similar to those described in connection with the first and second embodiments. In other words, features from one Figure may be used in other Figures. For example, the casing of the embodiment of FIG. 1 can be modified to reach to the forward outer edge of the air-encountering surface as has been illustrated in FIG. 6 or the radial projections of FIG. 1 can be replaced by the axially extending projections of FIG. 7. The pressed cylindrical charges of FIGS. 5 and 7 can be used in the embodiments of FIGS. 1 and 2 as well as the various configurations of the front end of the drive casing can be interchanged at will. The fin assemblies of the embodiments can likewise be interchanged without difficulty.

In FIG. 1 we have shown a munitions round having a projectile 10 of large length/diameter ratio with a longitudinal axis 11 and a penetrator 14 provided at its forward end with a point or tip (warhead) 12. The rearward end of the projectile is provided with a stabilizing guidance system 15 constituted by a plurality of angularly equispaced fins of any conventional design.

The center of gravity of the projectile 10 is located at 17 and a drive body or cage is formed predominantly ahead of this center of gravity in the direction of propulsion of the projectile, i.e. to the right. The munitions unit of FIG. 1, like the munitions units of the other Figures, can be fired from a barrel-type weapon having a barrel free from discontinuities and a chamber shaped to receive the munitions round.

The drive cage or body 20 comprises a plurality of segments 21 assembled together and having a cylindrical outer periphery which is of a diameter substantially equal to the diameter of the barrel. This circularly cylindrical surface or periphery has been represented at 33. The cylindrical surface 33 reaches from an air-confronting forward end surface 25 to a gas-pressure-receiving surface 22 at the rear portion of the drive cage or body 20.

The latter surface extends from a forward outer edge 23 to a rearward inner edge 24 axially spaced from the outer edge 23, the pressure-receiving surface having a drooping profile between these edges. The term "drooping" profile has been used to refer to a profile which is substantially hyperbolic or parabolic in cross section and which is of progressively decreasing diameter rearwardly with the rate of fall-off of the diameter being greatest proximal to the cylindrical surface 33.

Figure 4:
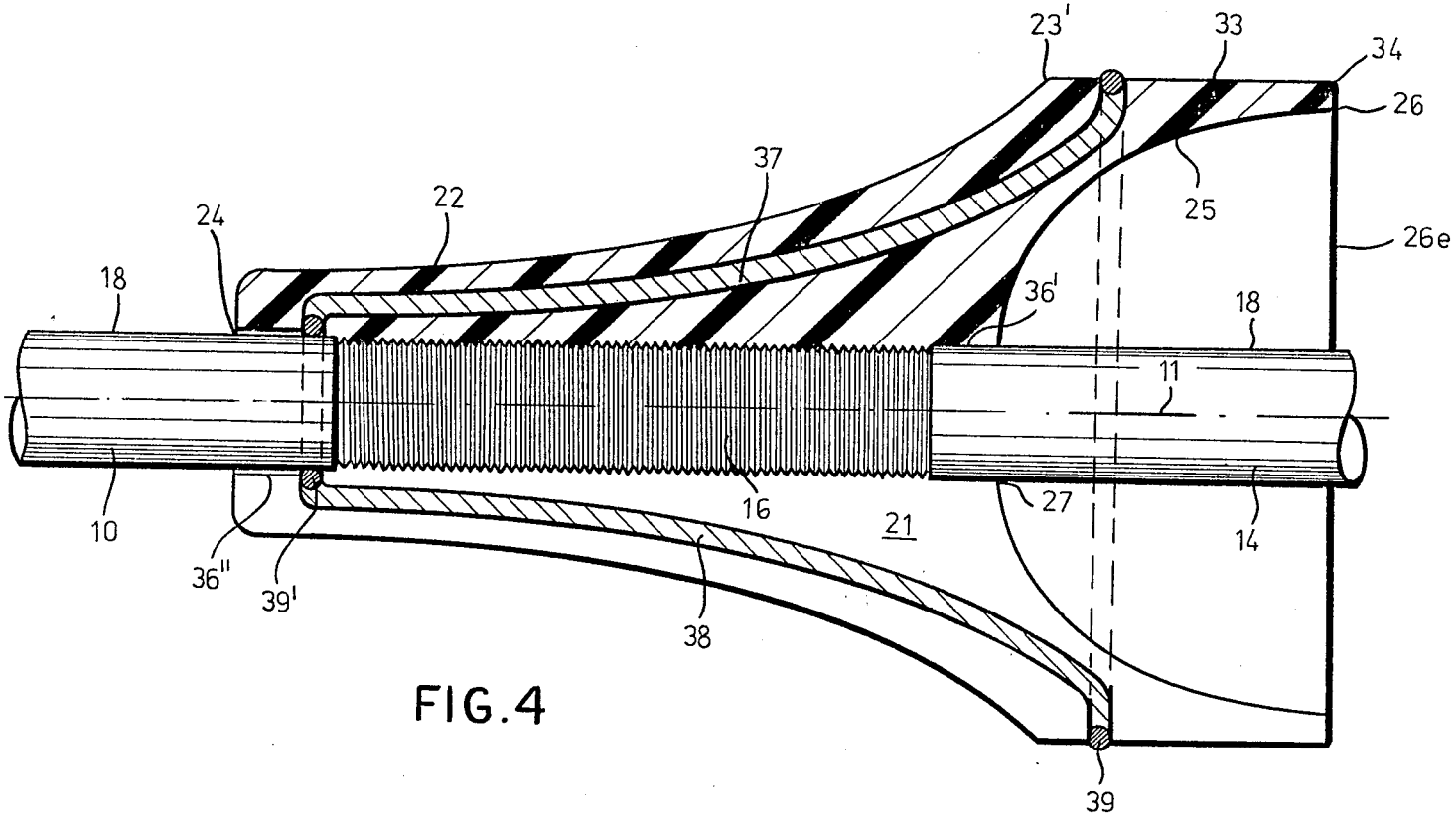
FIG. 4 is an axial cross-sectional view of a drive cage or body according to another embodiment of the present invention without radial projections and without the casing and charge.

The air-encountering surface 25 runs from a forward outer edge 26 radially spaced from the tip 12 of the projectile and, in the embodiment of FIG. 1, axially coterminous therewith, to an inner rear edge 27 which is proximal to the periphery of the projectile. In the embodiment of FIG. 4, as can readily be seen, the tip of the projectile projects beyond the edge 26 in the axial direction.

The air-encountering surface is thus forwardly concave and builds a static pocket whose rearwardly extending zone 27*a* projects axially in the direction opposite the arrow 13, the latter representing the firing direction, beyond the rear edge 27.

In the transition region 16 between the drive cage and/or body 20 and the projectile 10, running between the edges 24 and 27, a form-fitting connection is provided between the drive cage and the projectile. This form-fitting connection can be constituted by irregularities, not shown, which can be made up of male and female formations on the two interengaged parts which matingly interfit. The formations are symbolized by the screw threads shown in FIG. 4.

More specifically, the external periphery of the projectile 10 between the edges 24 and 27 may be formed with an external screw thread or the like, e.g. by machine, which form-fittingly engages a female thread machined in the drive cage or body 20.

Figure 8:
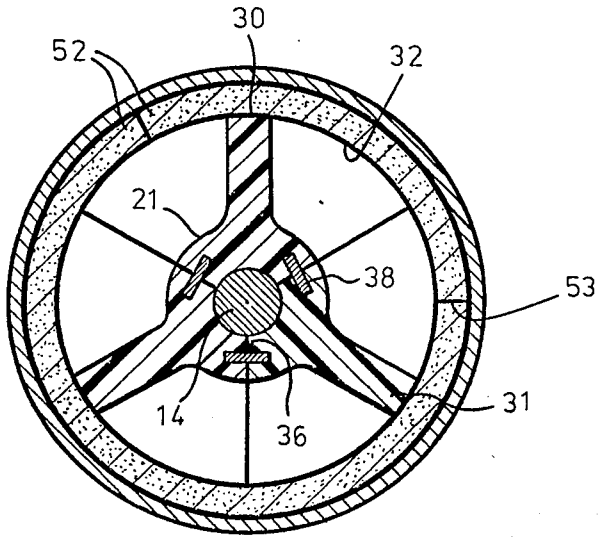
FIG. 8 is a cross-sectional view taken transverse to the longitudinal axis generally along the line VIII—VIII in FIG. 7.

In the region of the inner edge 24, the drive cage or body 20 is provided with a plurality of angularly equispaced radial projections 29 which overhang the pressure-receiving surface 22 and are formed thereon. The free ends of these projections 29 (see FIG. 8) are arranged and constructed to lie along a circular arc 32 of a diameter corresponding to the caliber of the barrel (FIG. 8).

A propellant-charge casing or shell 40 receives the projectile and is formed with a rear end 41 of relatively large diameter, corresponding to the diameter of the chamber of the weapon. The forward end 42 of the casing has an outer diameter substantially equal to the caliber of the barrel in which it is received.

The forward end 42 extends substantially to the cylindrical surface 33 and projects axially beyond the outer edge of the pressure-receiving surface in which it can be crimped to the body or cage 21. In the region of the projections 29, the outer edges of the latter bear indirectly or directly upon the inner surface of the portion 42 of the casing.

In the region of the base of the casing 40 there is provided a primer holder 44 which is attached in the usual manner and contains the primer element which, upon engagement by a firing pin or the like, ignites the propellant charge within the casing.

In the region at which the base 44 is connected to the rear portion 41 of the casing 40, the fin assembly 15 is stabilized by a centering element 43 which is provided with openings to transfer ignition of the charge behind this centering element 43 to the charge portion ahead of the latter.

The charge is represented at 50 and a portion thereof, shown at 51, fills a space 28 surrounding the gas-pressure-receiving surface 22 within the forward portion 42 of the casing. This portion 51 of the charge increases the energy with which the projectile assembly is fired from the barrel and thus increases the range of the projectile.

As is also apparent from FIG. 1, the pressure-receiving surface 22 is provided with a sealing coating 35 having a sealing lip 35' in the region of the outer edge 23.

Figure 2:
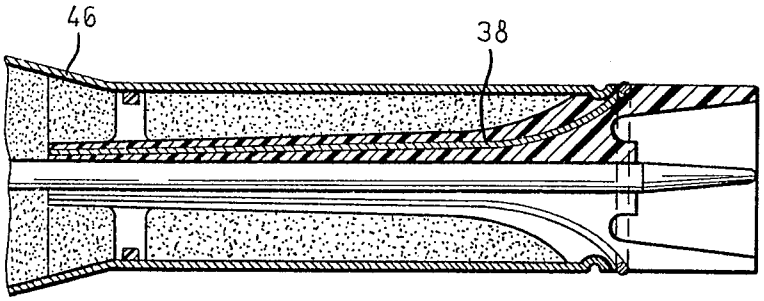
FIG. 2 is a partial axial cross-sectional view of a modification of the forward end of the munitions round of FIG. 1.

In FIG. 2 it can be seen that the mutually juxtaposed contact surfaces 35 (FIG. 8) between each pair of segments 21 are formed with grooves 37 (FIGS. 4, 5) in which a sealing element, i.e. a band or strip 38, is seated.

The grooves 37 to which the sealing elements 38 conform, extend substantially from the outer edge 23 to the inner edge 24. Gas thus cannot bleed past the body or cage during the firing of the projectile while the assembly is within the barrel. The embodiment of FIG. 1 can be provided either with the sealing elements of FIG. 2 or with those of FIG. 3.

Figure 3:
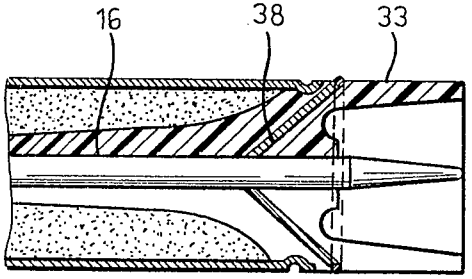
FIG. 3 is a section similar to FIG. 2 illustrating still another modification of the forward end of the projectile.

From FIG. 3 it will be apparent that the segments of the drive cage or body 20 are not provided with grooves which extend the full length of the pressure-receiving surface but have grooves only in the region of the cylindrical surface 33. Here the sealing elements 38 reach from the transition region 16 previously mentioned to the periphery 33.

The aforedescribed first embodiment requires, between the rear ends of the shell-receiving chamber and the calibered portion of the barrel, a transition region whose internal diameter corresponds substantially to the external diameter of the forward portion 42 of the casing. This transition region supports the casing portion 42 against which the radial projections 29 bear so that at the beginning of the firing process, i.e. when the assembly of the projectile 10 and the drive body or cage 21 begins to move in the direction of arrow 13, the inner wall of the portion 42 of the casing forms a guide along which the radial projections 29 travel and further secure the form-fitting connection between the projectile 10 and the drive body or cage 20 in the interfacial region 16.

A second embodiment of this invention has been illustrated partially in FIG. 4. In this case, the drive cage or body 20 in the region of the inner edge 24 of the pressure-receiving surface 22 has no radially outward projections. In the region of edges 24 and 27, moreover, the body closely surrounds the penetrator portion of the projectile with a seating surface 36'' or 36', respectively. The groove 37 at the confronting surfaces of the segments, which receives the sealing elements 38, here runs from the region of the periphery 33 substantially to the seating surface 36''.

At the latter, a sealing ring 39', i.e. an O-ring, is disposed to hug the periphery 18 of the projectile.

The sealing element 38 can, of course, be a separate element laid into each pair of grooves 37 although it has been found to be advantageous in some cases to embed it by injection molding or casting in the drive cage or body.

The forward end of the groove 37 is also partly sealed by an O-ring 39 which can bear upon the surface of the barrel or chamber surrounding the cylindrical peripheral portion 33 as previously described. Thus, by contrast with the first embodiment, this second embodiment can be free from the coating 35 previously described.

Also by contrast with the first embodiment, the embodiment of FIG. 4 has an air-encountering surface 25 which is not recessed behind the rear inner edge 27 surrounding the projectile 10. The point or tip of the projectile, not shown in FIG. 4, can lie forwardly of the outer forward edge 26 of the air-encountering surface which can lie in a plane **26*e*** perpendicular to the axis of the projectile.

Figure 5:
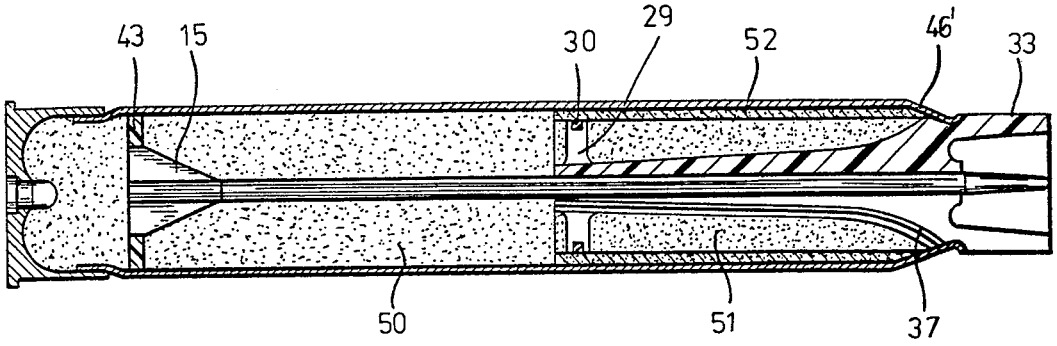
FIG. 5 is an axial cross-sectional view through a munitions round according to still another embodiment of the invention in which the casing also encloses a pressed body of the propellant charge which surrounds the pressure-receiving surface with a subcaliber fin-stabilized projectile.

In FIG. 5 we have shown another (a third) embodiment of a munitions round according to the invention in which the weapon has an axially longer chamber than is the case with the first embodiment. The drive cage or body of FIG. 4 can be used either with the stepped casing of FIG. 1 or with the substantially cylindrical casing of FIG. 5. The ammunition unit or round as a whole, therefore, has a substantially constant outer cross section over essentially its entire length.

In the embodiment of FIG. 5, the forward end of the otherwise cylindrical casing has a frustoconical portion 46' of limited length which engages the drive cage or body at the cylindrical portion 33 which conforms in caliber to that of the barrel. Thus the surface 33 is directly surrounded by the wall of the barrel of the weapon.

The radial projections 29 at the trailing end of the pressure-receiving surface can have free ends 30 which bear upon a circularly cylindrical compensating body whose internal diameter is equal to the caliber of the barrel. This body can be formed in part by a coherent pressed structure 52 of the propellant charge. The pressed-powder charge 52 here is a cylindrical member whose inner diameter is equal to the caliber of the weapon barrel and hence to the external diameter of the cylindrical portion 33. A portion of the usual non-pressed charge 51 is disposed between the pressure-receiving surface of the drive cage or body and the cylindrical pressed charge 52. The rate of combustion of the charge portion 52 can be slightly less than that of the charge portions 50 and 51 so that the cylindrical member 52 can act as a guide structure during the initial movement of the radial projections 29 in the direction of arrow 13 (see FIG. 1).

Figure 6:
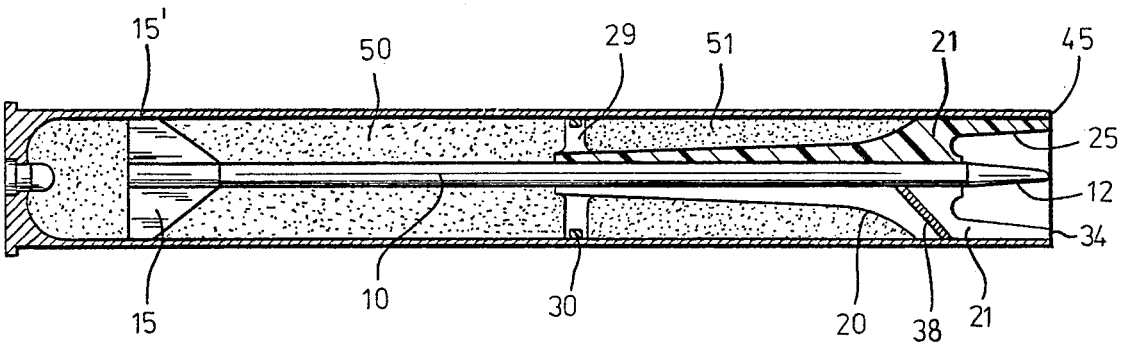
FIG. 6 is an axial cross-sectional view through a fourth embodiment of the present invention wherein the casing or shell extends axially to the leading outer edge of the air-encountering surface; this embodiment, unlike the system of FIG. 5 in which the fin has a subcaliber outer diameter, shows a subcaliber projectile having a fin equal in diameter to the caliber of the barrel of the weapon.
Figure 6A:
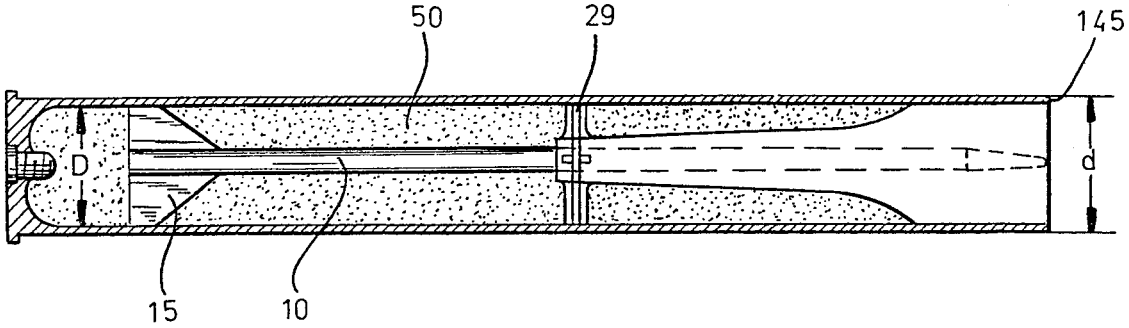
FIG. 6*a* represents a modification of FIG. 6.

In the fourth embodiment shown in FIG. 6, the casing is practically completely cylindrical and has no frustoconical transition region by which the drive cage or body is gripped. Here the cylindrical open end 45 of the casing is coterminous with the edge 34 of the drive cage or body and surrounds the latter. This arrangement has been found to be highly effective in protecting both the projectile 10 and the drive cage or body 20 during transport, loading and storage.

The inner diameter of the casing is equal to the caliber of the barrel and the munitions round can be inserted in the correspondingly shaped chamber of the weapon.

While the embodiment of FIG. 5 has a tailfin assembly which is supported by a disk 43 as described in connection with FIG. 1, the tailfin assembly 15 of the subcaliber projectile in the embodiment of FIG. 6 has its fins extending radially outwardly so that the diameter of the tailfin assembly is equal to the caliber of the barrel. This arrangement has been found to be especially effective for automatic weapons and high firing rates. While in the embodiment of FIG. 6 the radial projections 29 previously described have been illustrated, it will be understood that this modification does not require the radial projections since the positioning of the projectile via the guide cage 20 and the tailfin assembly 15 normally suffices.

Figure 7:
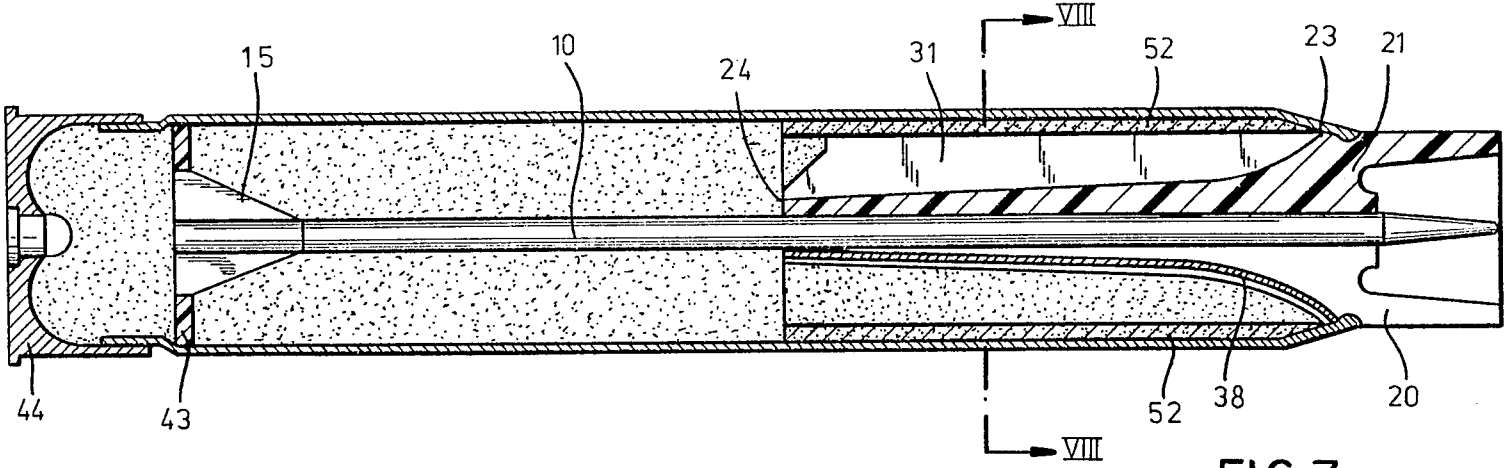
FIG. 7 is an axial cross-sectional view through a fifth embodiment of the present invention in which radial ribs along the pressure-receiving surface extend axially from the inner edge to the outer edge.

In the fifth embodiment of the invention, best seen in FIGS. 7 and 8, the radial ribs which project from the pressure-receiving surface of the drive cage or body extend axially from the inner edge 24 substantially to the outer edge 23. The outer edges of the angularly equispaced ribs 31 (see FIG. 8) bear upon the inner surface of the cylindrical pressed-charge unit 52 and are guided therein during the initial firing of the projectile. The ribs 31 are offset midway between the joints 53 between the pressed charge 52 when the latter is assembled from a plurality of segments. They are also offset angularly midway between the joints 36 between the segments 21.

The cartridge casing 40 is preferably at least partially composed of a combustible material, e.g. paper or synthetic resin, the detritus being expelled through the barrel of the gun so that upon firing from an enclosed space, such as the turret of a tank or other armored vehicle, the space will not become filled with empty casings.

As noted previously, the drive cage or body 20 can be provided with radial projections 29 or ribs 31 in each of the embodiments or can be free from such ribs or projections, especially when the stabilizing tailfin structure is of the type illustrated in FIG. 6. In all of the embodiments, moreover, a coating or sheath 35 of synthetic-resin material can be applied over the pressure-receiving surface. As a result of the constructions illustrated and described, all of the advantages previously mentioned are obtained.

FIG. *6a* shows a modification of FIG. 6 wherein the open end 145 has a diameter d which is less than the diameter D of the casing at its opposite end so that the entire casing has a taper of 1:60 to 1:80 from one end to the other, i.e. decreases in diameter toward the open end by unit of measurement for each 60 units to 80 along the length.

We claim:

1. A munitions round for a barrel-type weapon, comprising:

an elongated casing having a closed rear end and an open forward end;

a fin-stabilizing subcaliber elongated projectile wholly disposed in said casing with clearance, said projectile having a large length/diameter ratio, a center of gravity between its ends, a leading end terminating in a plane of said open forward end, and a fin assembly at a tail and guided on an inner wall of said casing;

a gas-generating propellant charge in said casing at least partly surrounding said projectile; and an elongated drive body form-fittingly engaging said projectile and disposed at least in part forwardly of said center of gravity in the direction of propulsion of said projectile, said drive body being formed with:

a plurality of segments mutually contacting at angularly spaced confronting contact surfaces at which said segments separate upon emergence of the projectile from the barrel of said weapon, a forwardly concave air-encountering surface formed by said segments and defined between a leading outer edge spaced radially from the periphery of said projectile but lying in said plane and a trailing inner edge proximal to said periphery of said projectile and rearwardly of said outer edge, an outer periphery of said body formed by said segments having a diameter substantially equal to the caliber of said barrel and engaged by said forward end of said casing, at least one sealing member bridging the mutually confronting contacting surfaces, and a pressure-receiving surface extending rearwardly from said outer periphery of said body at a circular outer edge thereof to an inner edge proximal to the periphery of said ,projectile and axially rearwardly of said outer edge of said body, said pressure-receiving surface being of progressively decreasing diameter rearwardly and defining a space with said casing receiving a portion of said charge, said pressure-receiving surface being outwardly concave at least in the region of said outer periphery of said body, said drive body being formed in the region of said inner edge of said pressure-receiving surface with a plurality of radially outwardly extending projections having free ends lying along circular arcs of substantially the diameter of the caliber of said barrel, said air-encountering surface defining a pocket receiving a static quantity of air and extending rearwardly of said inner edge of said air-encountering surface.

2. The munitions round defined in claim 1 wherein said radial projections are formed as ribs which extend axially to the region of said outer edge of said pressure-receiving surface.

3. A munitions round as defined in claim 1, or claim 2 wherein said air-encountering surface defines a pocket receiving a static quantity of air and extending rearwardly of said inner edge of said air-encountering surface.

4. The munitions round defined in claim 1 or claim 2 wherein the casing is at least partially combustible.

5. The munitions round defined in claim 1 or claim 2 wherein the portion of the charge surrounding said pressure-receiving surface is formed as a coherent pressed body on the charge.

6. The munitions round defined in claim 5 wherein said pressed body of the charge has a circular cylindrical configuration of a diameter substantially equal to the caliber of the barrel.

7. The munitions round defined in claim 1 wherein said projectile has a fin assembly braced against the inner wall of said casing proximal to said rear end thereof.

8. The munitions round defined in claim 1 wherein said portion of said charge is at least in part formed as a pressed body of cylindrical coherent configuration having an inner diameter corresponding to the caliber of the barrel.

9. The munitions round defined in claim 1 wherein said casing has a uniform cross section over its entire length.

10. The munitions round defined in claim 1 wherein said casing tapers uniformly from one end to another with a taper of 1:60 to 1:80.

* * * * *